US005813359A

United States Patent [19]

Hall

[11] Patent Number: 5,813,359

[45] Date of Patent: Sep. 29, 1998

[54] ROWBOAT WITH PERMANENT SUBMERSIBLE WHEELS

[76] Inventor: Fletcher G. Hall, 16 Beach Ave., Salem, Mass. 01970

[21] Appl. No.: 789,795

[22] Filed: Jan. 28, 1997

[51] Int. Cl.[6] ..... B63C 13/00

[52] U.S. Cl. ..... 114/344; 114/347; 114/140

[58] Field of Search ..... 114/343, 344, 114/219, 270, 140; D12/314, 317

[56] References Cited

U.S. PATENT DOCUMENTS

| | | | |
|---|---|---|---|
| 2,223,855 | 12/1940 | Powell | 114/270 |
| 2,413,850 | 1/1947 | Swennes | 114/270 |
| 4,920,909 | 5/1990 | Grassi et al. | 114/344 |

FOREIGN PATENT DOCUMENTS

| | | | |
|---|---|---|---|
| 2355682 | 1/1978 | France | 114/344 |
| 839744 | 6/1981 | U.S.S.R. | 114/270 |
| 1472535 | 5/1977 | United Kingdom | 114/270 |

*Primary Examiner*—Ed. L. Swinehart

[57] ABSTRACT

A rowboat with a pair of permanantly mounted wheels installed in the middle of opposed sides of bottom of boat. A pair of wheel wells isolate the wheels from interior of boat, thereby removing most of the wheels from exposure to turbulance and drag. The wheels are supported by and rotate around an axle. The axle is cradled in a recess molded into bottom of boat. A pair of skegs or keels are molded into boat and aligned longitudinally with direction of wheel travel. Fastened to bottom of skegs is a replacable plastic wear resistant tube split in half longitudinally. Thus providing a rowboat that is easy to move on land as well as water and has significant wear resistance on bottom.

8 Claims, 5 Drawing Sheets

ROWBOAT WITH PERMANENT SUBMERSIBLE WHEELS

BACKGROUND

1. Field of Invention

This invention relates to the hauling and launching of a rowboat, and the transporting of a rowboat to safe storage.

2. Description of Prior Art

Many rowboats are used as transportation to and from a larger boat and still others are used for recreation. Most of these rowboats are stored on land, when not in use. They need to be stored in a safe place away from tide and vandals. An eight foot rowboat can weigh as much as eighty pounds, and as such can be difficult or impractical to carry even short distances. Dragging a boat across a sandy or rocky beach can easily wear a hole in wood or fiberglass.

People have solved this problem in the past by many different methods. The least complicated but least reliable solution is to find someone to help carry the boat. Many inventors have attempted to solve this problem in the past with only moderate success. U.S. Pat. No. 4,850,605 to Ray (1988) discloses a dolly arrangement that requires the user to engage the dolly onto the side of the boat and then tip the boat up on edge. Then the boat must be pulled or pushed over probably uneven terrain and balanced at the same time. When the boat reaches the edge of the water it must be lowered to the horizontal (or rowing) position and the dolly apparatus removed. At this time the user is required to drag the boat far enough into the water to permit the additional weight of user and boat to acheive flotation. Upon returning to shore the user must reverse the process by re-attaching the dolly, tipping the boat onto its side and again pulling and balancing the boat back to its safe home.

U.S. Pat. No. 5,000,468 to Weinstein (1989) shows an apparatus performing a similar function to the aforementioned. This dolly requires less balancing because it has four wheels instead of two,but still requires clamping, tipping, lowering and dragging of boat.

Some amphibious vessels have attempted to solve this problem. One of these is U.S. Pat. No. 5,211,127 (1990) to Sprunger called a Mobile Boat shows a boat with wheels mounted at gunwale or rail level. When the boat is hauled from water it must be inverted or turned over at which time the wheels will function. This device still requires that the boat be dragged away from water until it can be easily inverted.

Another amphibious vessel is U.S. Pat. No. 5,199,372 to Seligman and Wall (1990) discloses a vessel with permanently mounted wheels. These wheels must be raised and lowered. When the boat is in the water and the wheels are in the raised position the wheels would impede if not prevent the user from rowing the boat. These wheels also are very unsightly. Other amphibious vehicles have been produced in the past, including military vehicles. These amphibious vehicles are motorized and designed to operate and conform to land use as a primary function. Little or no attempt is made to promote the smooth flow of water by the wheels. A rowboat is human powered and as such must be designed with a minimum of rowing resistance.

Many of the aforementioned apparatus have many mechanical parts. These parts are often prohibitively expensive or unavailable in non-corrosive materials.

OBJECTS AND ADVANTAGES

The objects and advantages of this invention are:

(a) To provide a rowboat that can be easily pulled over sand, small rocks, asphalt, grass, and other similar terrain with no damage to boat.

(b) To provide a rowboat with permanent wheels producing a minimum of turbulance and drag as it travels through the water.

(c) To provide a boat that rows well, having two deep skegs or keels to help track (travel a strait line) well in the water.

(d) To provide a boat with a bottom that is protected by a replaceable wear surface in PVC pipe split longitudinally and applied to bottom of fiberglass skegs.

(e) To provide a boat that requires no preparation to travel over land. It does not need to be turned over or on its side. It does not need the attachment of dollies and subsequent removal of dollies.

(f) To provide a boat with wheels mounted approximately amidships (roughly center of balance) that requires only five pounds of lift at forward end. Said wheels having large pneumatic tires to provide excellent mechanical advantage.

DRAWING FIGURES

In the drawings, closely related figures have the same number but different alphabetic suffixes.

FIG. 1*a* shows a front end view of boat with fiberglass wheel wells and skegs, PVC protective tubing, and pneumatic tires.

FIG. 1*b* shows the wheel assembly if it were to be removed from boat.

FIG. 2*a* shows a profile or side view of boat.

FIG. 2*b* shows a half-size section through fiberglass skeg and PVC tube.

REFERENCE NUMERALS IN DRAWINGS

Figure 1A:
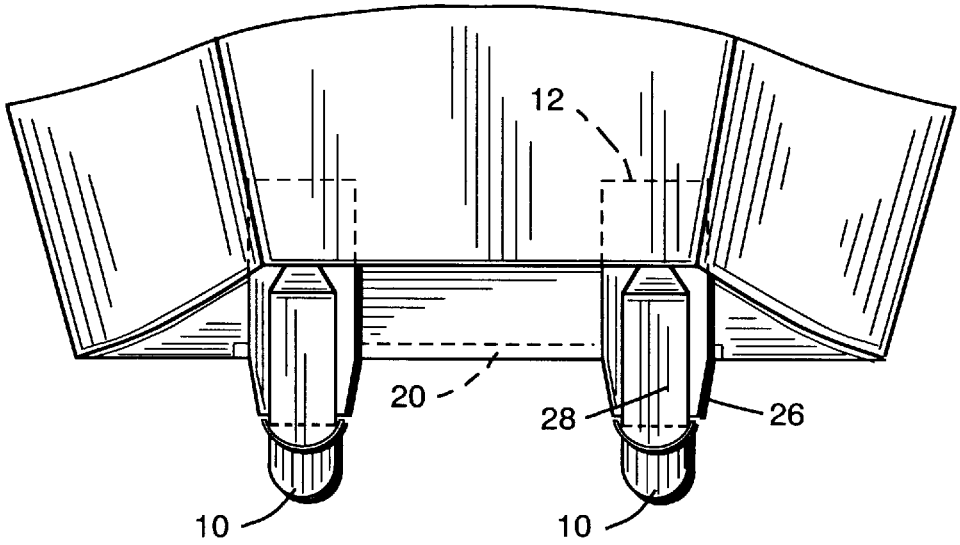

10 Plastic rimmed pneumatic wheels
12 Fiberglass wheel wells
14 Axle
16 Side bearing
18 Screw to secure side bearing
20 Recess to receive axle
22 Screw to secure axle
24 Removable wheel cover or skirt
26 Fiberglass skegs
28 3" diameter split PVC tube
30 Tapered lead-in PVC tube
32 Ridge in skeg to which PVC tube is mounted
34 Screw to mount PVC tube

DESCRIPTION —FIGS. 1 to 4

A front end view of this invention is illustrated in FIG. 1*a*. A wheel assembly (FIG. 1*b*) is shown permanently installed in the bottom of boat. A wheel well 12 at each wheel is formed in the mold, from which each fiberglass boat is constructed. Said wheel well isolates the wheels to the exterior of the boat, thus maintaining a watertight vessel.

Figure 1B:
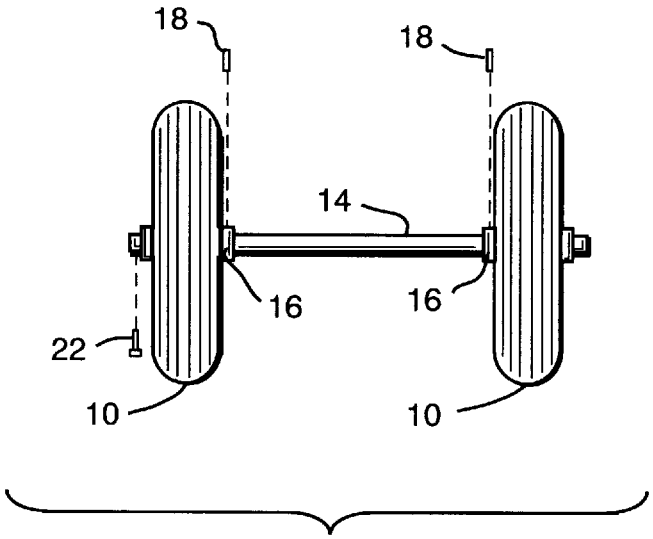

FIG. 1*b* shows a wheel assembly as if it were removed from the boat. A pair of pneumatic tires 10, size 480-8,2 ply, wheelbarrow tread tubeless tire with 3 ¾" composite plastic drop center rim with 1" bore by Carlisle Tire and Wheel Co. of Aiken, S.C. The aforementioned two wheels are slid onto an axle 14 of standard 1" outside diameter stainless steel tubing. Said wheels are located equal distance from ends of axle and centered in each wheel well 12. The center line of each wheel is separated by a distance of 1'-6" along said axle. Wheels are retained laterally to prevent contact with wheel wells by means of side bearings 16 comprised of Nylon sleeve or bushing with 1.035 I. D. bore to slide onto axle and 1.539 diam. to bear against side of wheel. Each wheel has a side bearing on each side. These side bearings are fixed to axle with a stainless steel machine screw 18 #10-32 by ½" drilled and tapped into axle.

The wheel assembly described above is then inserted into wheel wells 12 and the aforementioned axle 14 is nested or cradled in a recess 20 molded into the hull. This recess provides a positive location for axle and minimizes impedance of water flow along bottom of boat. Each end of said axle 14 has a hole through both walls of tubing. A screw 22 (stainless steel #12×2" tapping) is passed through the aforementioned holes and secured to fiberglass at bottom of recess 20, thus securing axle to bottom of boat.

Figure 2A:
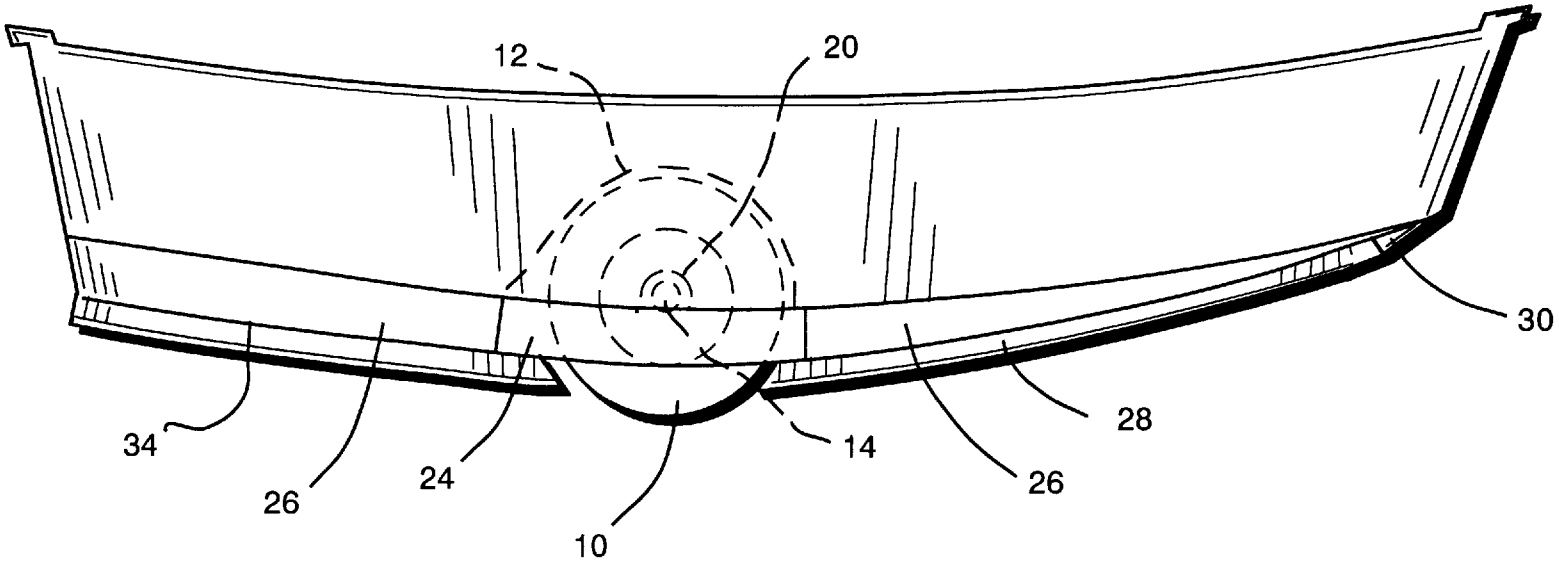

FIG. 2*a* shows a profile or side view of boat. The aforementioned wheel assembly is shown installed in boat. A pair of skegs 26, or keels, is molded longitudinally into each fiberglass boat. Each skeg starts on bottom at outside edges of pram bow, or front of boat, with a downward projection of 0". The projection tapers with a gentle curve to a downward projection of 3" at beginning of wheel well 12. The skeg is interupted or eliminated in the area of the wheel well. The profile, or depth, of skeg resumes at rear of wheel well with a dimension of 3 ¼". This dimension stays consistent as skeg follows profile of bottom of boat to transom at rear of boat. Said pair of skegs are positioned parallel to one another from bow to stern.

Figure 2B:
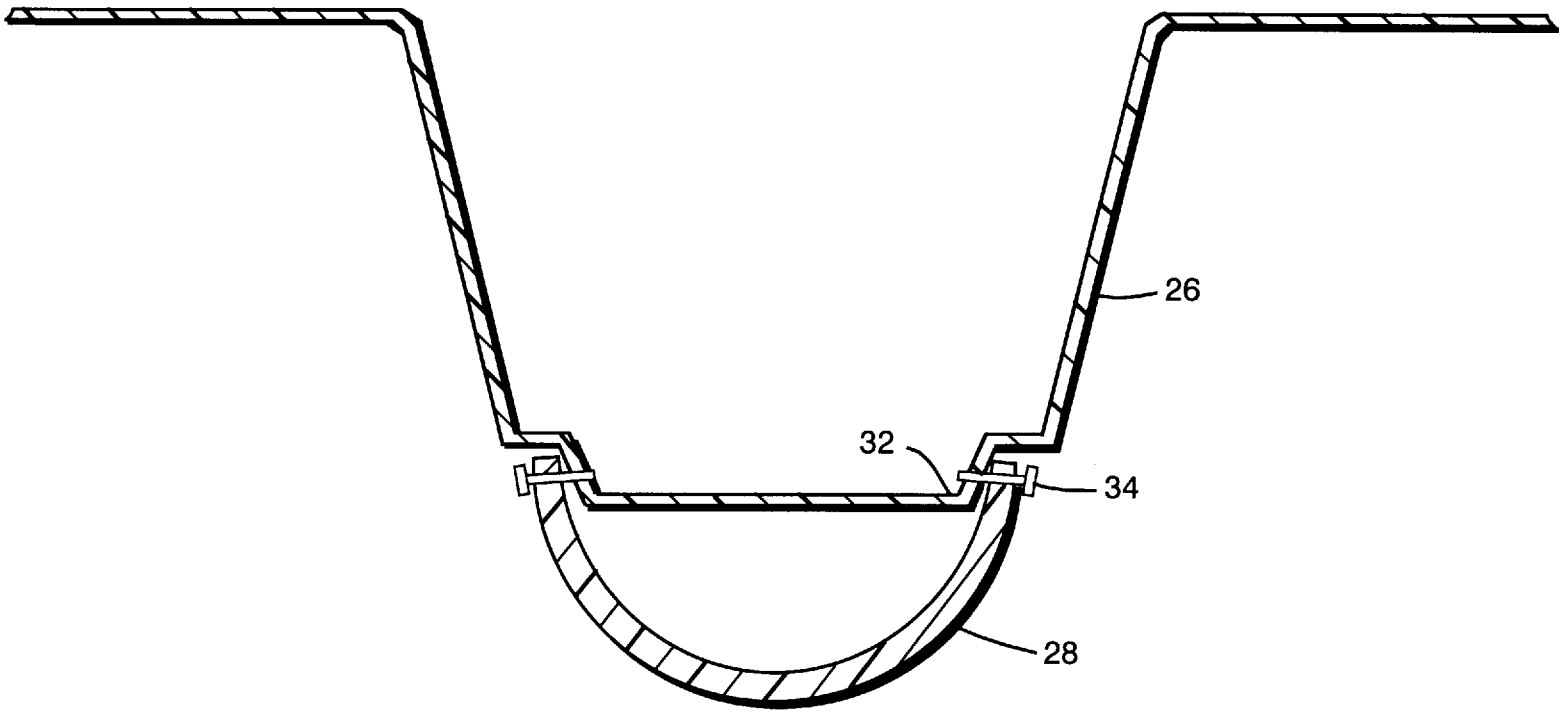
Figure 3:
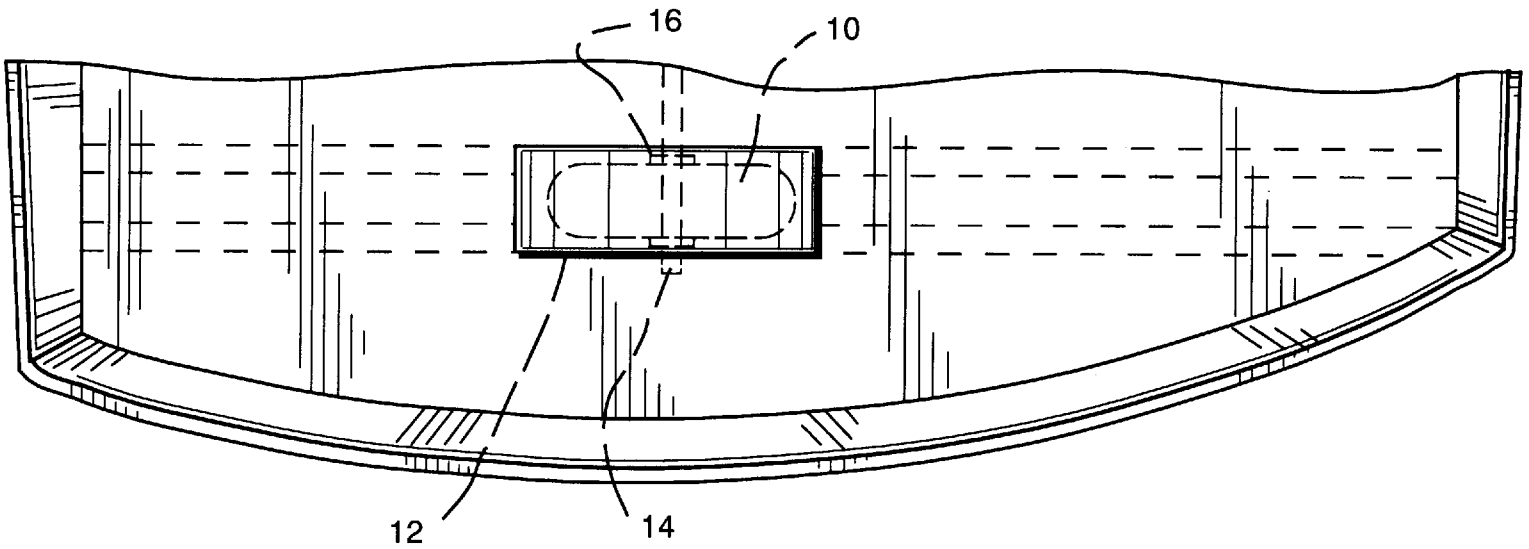
FIG. 3 shows a half-breadth or half-plan view of boat.
Figure 4:
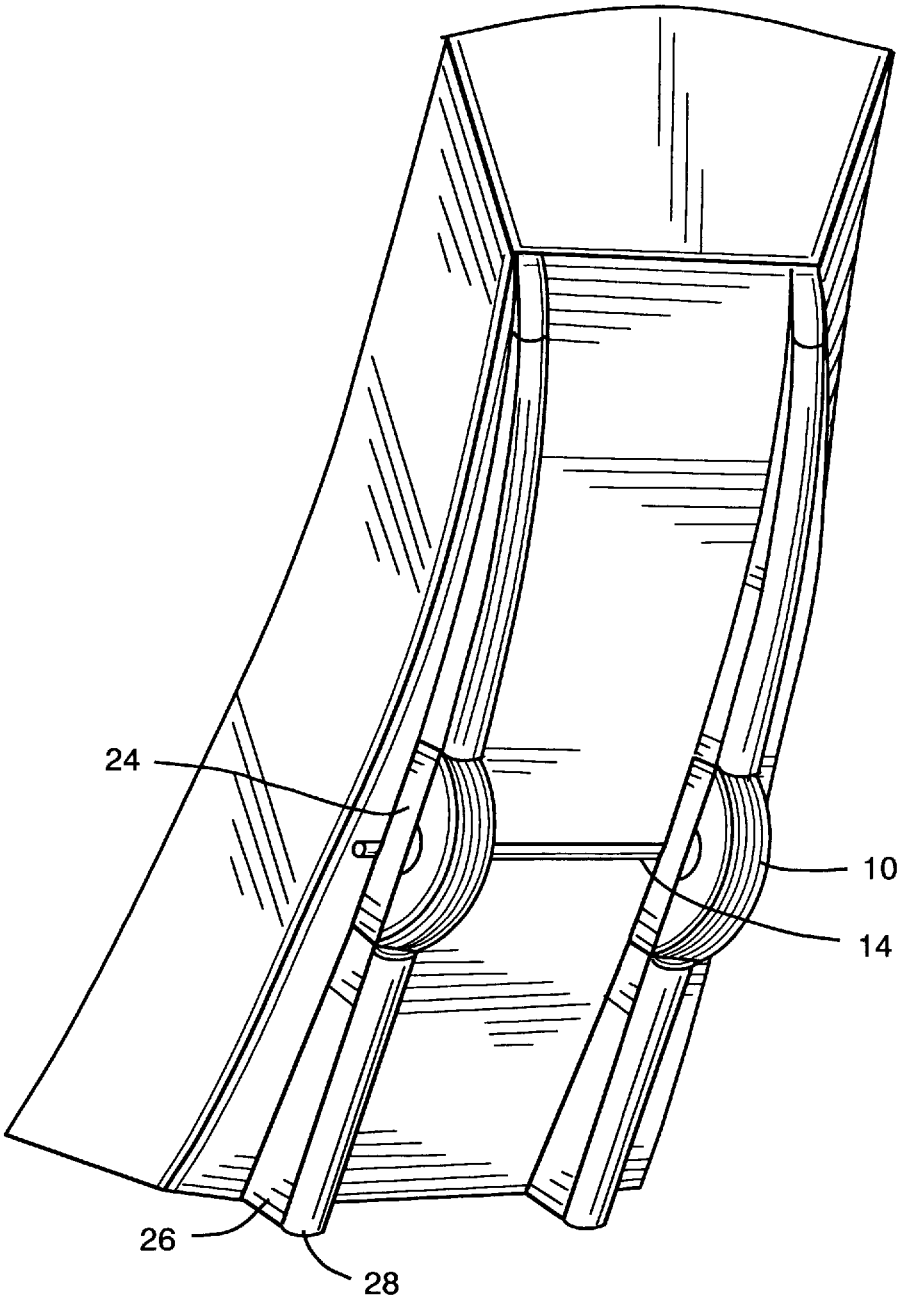
FIG. 4 shows a perspective view fo boat with front end raised.

FIG. 2*b* shows a cross-section of the aforementioned skeg. Centered on bottom of skeg and also molded into fiberglass is a ridge 32, or further downward projection. This ridge is formed to receive a PVC tube 28 split in half longitudinally. This split tube of "Schedule 80" (impact resisant) PVC is fastened to skeg with a series of screws 32 #8×¾" stainless steel tapping. At forward end of boat a seperate piece of PVC tube 30 is tapered from ¼" at forward most point to full half section or semi-circle (in cross section view) at 9" from forward most point. This tapered section of tube allows water to flow with minimal disurbance onto skeg area.

FIG. 2*a* also shows a removable wheel cover 24 which is a channel shape. The bottom or connecting leg of channnel shape is cut out to allow wheel 10 to project through. This wheel cover promotes the smooth flow of water by the wheel area, thus minimizing water turbulance and drag at sides of wheels.

Operation

The manner of using this boat is that one may pick up bow (approximately five pounds of lift weight) and pull in upright rowing position. Large pneumatic tires make travel over sand, small rocks and asphalt very easy, thus long distances may be traversed with minimal strain. Upon reaching beach or launching ramp, one needs only to launch (roll into water) and step aboard. Rowing is similar to any conventional rowboat. Upon returning to shore the above procedure is reversed. This boat may also be used to transport gear or small children by simply placing in boat and pulling.

Summary, Ramifications, and Scope

The reader will see that the rowboat described above can be used and easily transported by children as young as 8 years of age and adults alike. In addition, this boat requires no turning over of heavy boat or clamping, strapping, or tying of auxiliary moving equipment. Nor does it require complex raising and lowering mechanisms.

It provides the easy transport of a rowboat without additional auxiliary equipment.

It allows user to simultaneously transport boat, boat gear, coolers, fishing gear, and other related equipment.

It provides sicnificant mechanical advantage over smaller wheels that are are common on boat dollies.

It allows user to step aboard with dry feet as boat may be boarded with bow still on dry land. The wheels will roll boat to deeper water.

It provides mechanical equipment that is non-corrosive and requires no lubrication and little maintenance.

It provides a boat with permanent submersible wheels which, when rowing, exposes only 10 per cent (bottom 3" of 16" diameter wheel) of the wheel area to turbulance and drag.

What is claimed is:

1. A watercraft having a hull with a bottom and a longitudinal axis, the watercraft comprising at least one skeg formed on the bottom of said hull, each said skeg extending substantially from bow to stem therof, and having a discontinuity formed at approximately amidships, one non-retractable wheel associated with each said skeg, and mounted at said discontinuity and extending from a wheel well formed in the bottom of the hull, each said wheel well and each said wheel being aligned with its associated skeg, and said wheel generally forming a continuation of said skeg across said discontinuity.

2. The watercraft of claim 1 further comprising a seat supported by the wheel well.

3. The watercraft of claim 1 wherein the non-retractable wheel is corrosion resistant.

4. The watercraft of claim 1 wherein the non-retractable wheel is mounted at the center of balance of the watercraft.

5. The watercraft of claim 1 also comprising a replacable, wear resistant covering attached to the skeg.

6. The watercraft of claim 1 also comprising a turbulance reducing structure adjacent to the non-retractable wheel to promote a smooth flow of water around the non retractable wheel.

7. The watercraft of claim 6 wherein the turbulance reducing structure limits exposure of the non-retractable wheel to at most about ten percent of the area of the wheel.

8. The waterscraft of claim 1 comprising:

said at least one skeg comprising a pair of skegs, an axle running transverse to the longitudinal axis, the axle mounted at approximately the center of balance of the watercraft; and a pair of said wheels, with each said wheel mounted mounted to the hull by an axle, the wheels extending from respective wheel wells in the bottom of the boat.

* * * * *